US006264504B1

(12) United States Patent
Wu

(10) Patent No.: US 6,264,504 B1
(45) Date of Patent: Jul. 24, 2001

(54) ELECTRICAL CONNECTOR

(75) Inventor: Kun-Tsan Wu, Tu-Chen (TW)

(73) Assignee: Hon Hai Precision, Taipei Hsien (TW)

( * ) Notice: Subject to any disclaimer, the term of this patent is extended or adjusted under 35 U.S.C. 154(b) by 0 days.

(21) Appl. No.: 09/396,981

(22) Filed: Sep. 15, 1999

(30) Foreign Application Priority Data

Dec. 31, 1998 (TW) ..... 87222072

(51) Int. Cl.[7] ..... H01R 13/648
(52) U.S. Cl. ..... 439/607; 439/357
(58) Field of Search ..... 439/607–610, 439/350–358

(56) References Cited

U.S. PATENT DOCUMENTS 5,362,249 * 11/1994 Carter ..... 439/609
5,766,041 * 6/1998 Morin et al. ..... 439/609
5,769,666 * 6/1998 Wu ..... 439/607
5,797,770 * 8/1998 Davis et al. ..... 439/609
5,975,954 * 11/1999 Wu et al. ..... 439/607

* cited by examiner

*Primary Examiner*—Gary F. Paumen
(74) *Attorney, Agent, or Firm*—Wei Te Chung

(57) ABSTRACT

An electrical connector in accordance with the present invention comprises a dielectric housing having two receiving chambers, a number of contacts received in the receiving chambers, and a shielding system for shielding the connector from electromagnetic interference and electrostatic discharge. The shielding system comprises an outer shield for enclosing the housing and a pair of inner shields received in the corresponding receiving chambers of the housing. Each inner shield forms several latching arms and detents inwardly extending toward the corresponding receiving chambers of the housing for electrically contacting a shell of a mating connector. Each latching arm further forms a latching tab inwardly extending therefrom for increasing the retention force between the inner shields and the shell of the mating connector. Each latching tab extends in a direction opposite a direction in which the corresponding latching arm extends, thereby providing better deformation resilience between the latching tabs and the shell of the mating connector.

4 Claims, 4 Drawing Sheets

ELECTRICAL CONNECTOR

BACKGROUND OF THE INVENTION

The present invention relates to an electrical connector, and particularly to an electrical connector which can securely engage with a mating connector.

As communication frequency between electronic systems increases, electromagnetic interference (EMI) emitted from the electronic systems or surrounding devices has more adversely affects signal transmission. Therefore, a conventional connector commonly comprises one or more shields for protecting the connector from EMI.

When an electrical connector is mated with another connector, electrostatic discharge (ESD) may occur between two conductive shields or conductive components of the connectors. In serious cases, sparks may be generated between the shields or the terminals thereby damaging sensitive electronic circuitry. Therefore, a conventional connector commonly has one or more shields each forming one or more projections for conducting ESD therethrough.

Pertinent conventional connectors are disclosed in U.S. Pat. No. 5,362,249, and Taiwan Patent Application Nos. 85213720 and 86200240. Referring to FIG. 1, an electrical connector comprises a dielectric housing 6 receiving a plurality of contacts therein, and a conductive shroud 7 enclosing the housing 6. The shroud 7 forms a plurality of detents 72 integrally extending inward from peripheral side walls thereof for electrically contacting a shell of a mating connector thereby forming a grounding loop therethrough. However, retention forces applied by the detents of the shroud 7 are usually insufficient for securely retaining the mating connector after the mating connector is inserted into the connector. Thus, the shell of the mating connector may easily become loosened or slide away from the connector thereby resulting in poor electrical connection or even disengagement therebetween.

BRIEF SUMMARY OF THE INVENTION

A main object of the present invention is to provide an electrical connector which can establish secure electrical engagement with a mating connector.

Another object of the present invention is to provide an electrical connector having a shield system for protecting the connector from electromagnetic interference and electrostatic discharge.

An electrical connector in accordance with the present invention comprises a dielectric housing receiving a plurality of contacts therein, and a shielding system consisting of an outer shield enclosing the housing and a pair of inner shields received in the housing for providing an improved shielding effect. Each inner shield forms a number of latching arms inwardly extending from peripheral walls thereof toward an inner space, and a detent extending from a bottom wall thereof.

Each latching arm further forms an inwardly extending latching tab thereby increasing a retention force between the inner shields and the shell of the mating connector. Each latching tab extends in a direction opposite to a direction in which the corresponding latching arm extends, thereby providing better deformation resilience between the latching tabs and the shell of the mating connector. Thus, improved grounding effects and electrical connections can be achieved via the shielding system.

Other objects, advantages and novel features of the invention will become more apparent from the following detailed description when taken in conjunction with the accompanying drawings.

DETAILED DESCRIPTION OF THE INVENTION

Figure 3:
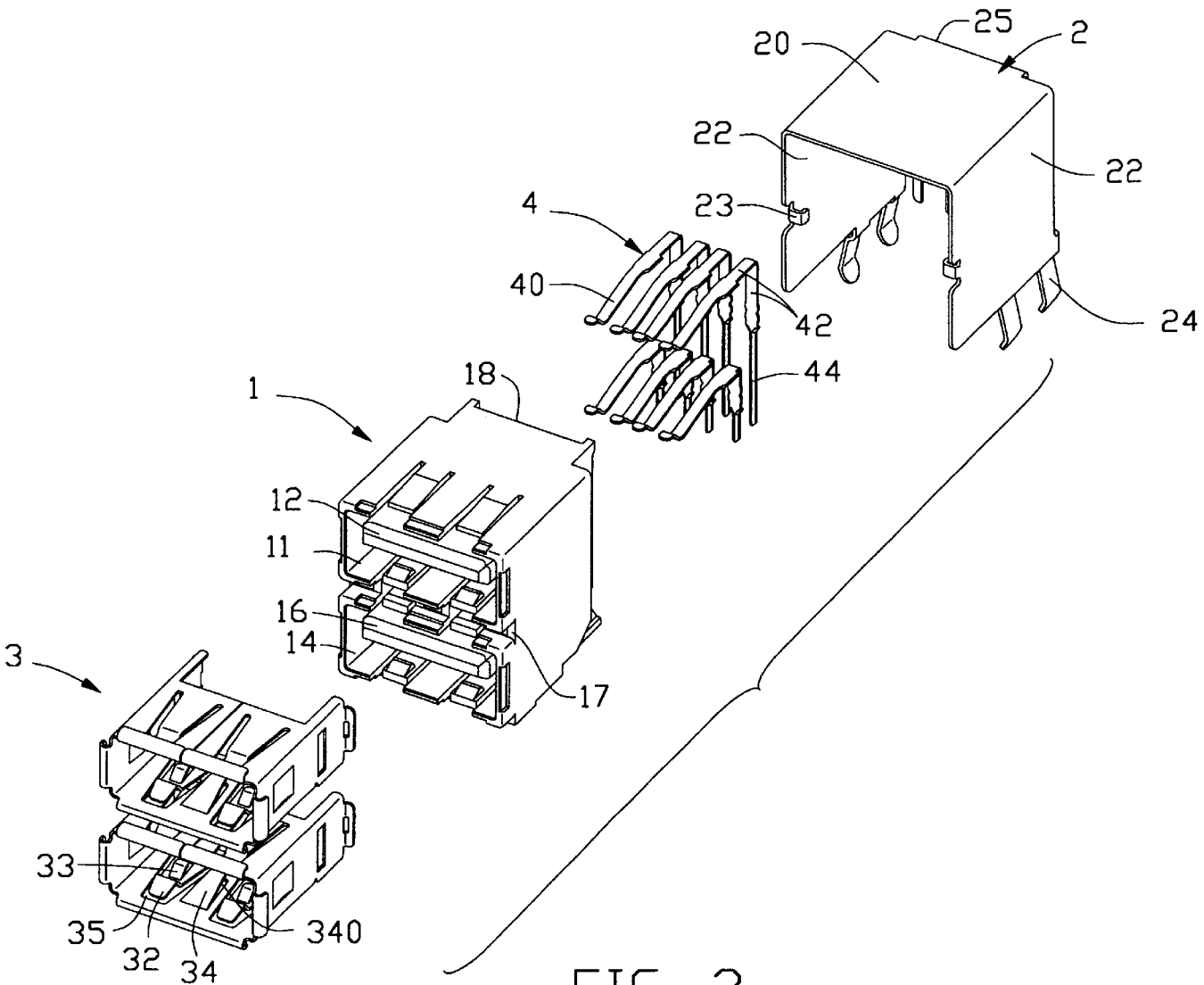
FIG. 3 is an exploded view of FIG. 2.

Referring to FIG. 3, an electrical connector in accordance with the present invention comprises a dielectric housing 1, a plurality of contacts 4 received in the housing 1, and a shielding system. The shielding system includes an outer shield 2 enclosing the housing 1 and a pair of inner shields 3 received in the housing 1.

Figure 4:
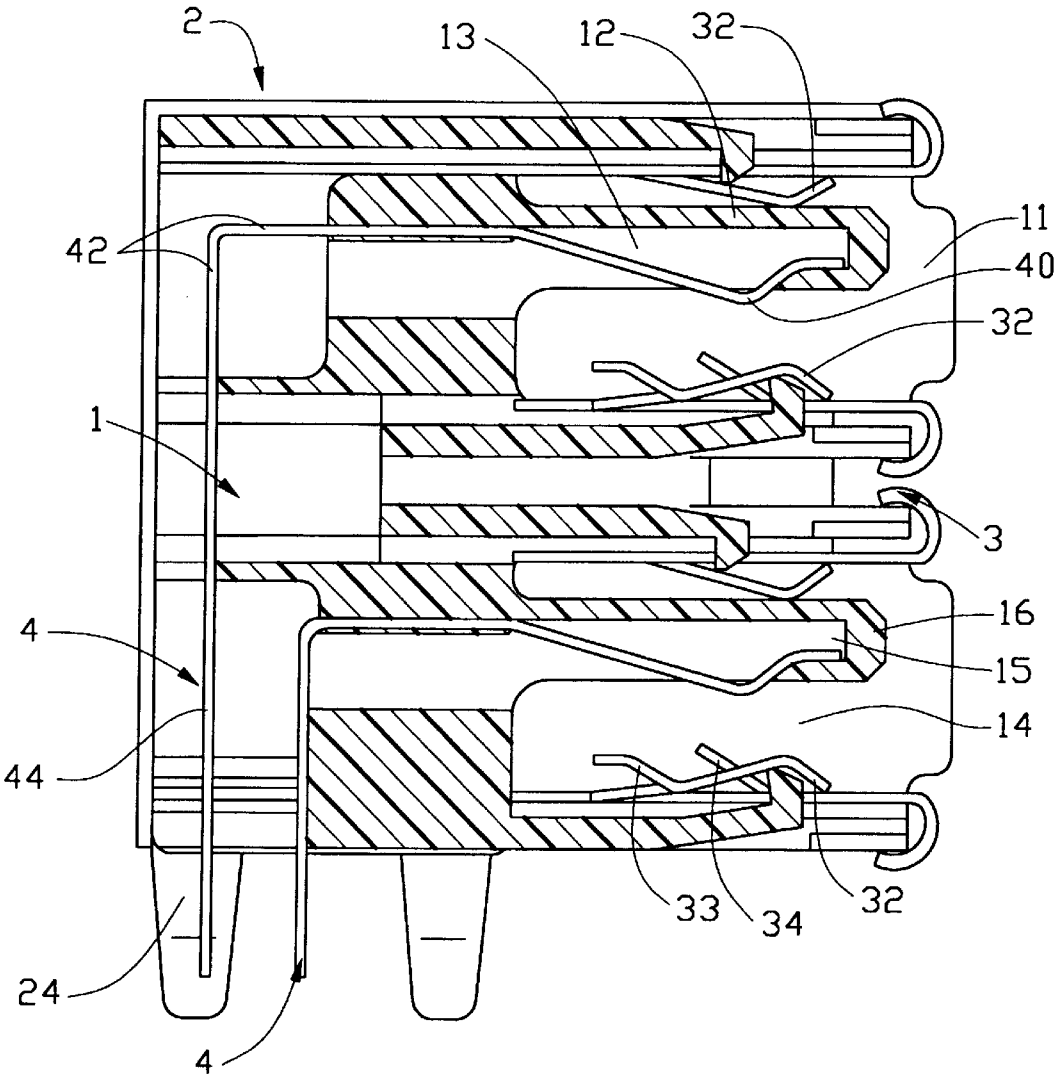
FIG. 4 is a cross sectional view taken along line 4—4 of FIG. 2.

Also referring to FIG. 4, the housing 1 defines two receiving chambers 11, 14 for receiving corresponding mating connectors therein. Each receiving chamber 11, 14 has a mating board 12, 16 cantilevered therein and a plurality of engaging slots 13, 15 formed in the mating boards 12, 16 for receiving the corresponding contacts 4. The contacts 4 comprise two groups for being respectively received in the two receiving chambers 11, 14. Each contact 4 comprises a contacting end 40 for electrically contacting corresponding terminals of a mating connector (not shown), a securing section 42 for latching in the corresponding engaging slot 13, 15 and a connecting end 44 for electrically connecting with a circuit board (not shown).

The shielding system is composed of the outer shield 2 and two inner shields 3 as depicted above. The outer shield 2 of the shielding system forms a top wall 20 and a pair of opposite side walls 22. A clamp 25 extends from one edge of the top surface 20 and is located between the side walls 22 for engaging with a top cutout 18 defined in an edge of a top wall of the housing 1. A pair of lugs 24 downwardly extends from each side wall 22 for fixing the connector to the circuit board. A pair of clasps 23 inwardly extend from the side walls 22, opposite the clamp 25 for latching corresponding middle cutouts 17 defined in side walls of the housing 1 between the receiving chambers 11, 14.

Each inner shield 3 defines two pairs of openings 35 in opposite upper and lower walls, and an aperture 340 in the lower wall. A cantilevered latching arm 32 extends into each opening 35 for electrically contacting a shell of the corresponding mating connector. A detent 34 extends into the aperture 340 for abutting against the shell of the mating connector. Each latching arm 32 of the lower wall further forms a latching tab 33 inwardly extending therefrom thereby increasing the retention force between the inner shield 3 and the shell of the mating connector. Each latching tab 33 extends in a direction opposite to a direction in which the corresponding latching arm 32 extends thereby providing better deformation resiliency allowing the latching arms 32 and the latching tabs 33 to more securely engage the shell of the mating connector. Thus, the latching arms 32 and the latching tabs 33 in cooperation with the detents 34 reliably secure the mating connector to the electrical connector thereby preventing disengagement between the inner shield 3 of the electrical connector and the shell of the mating connector, thereby forming a stable grounding loop therethrough to discharge electrostatic electricity.

Figure 1:
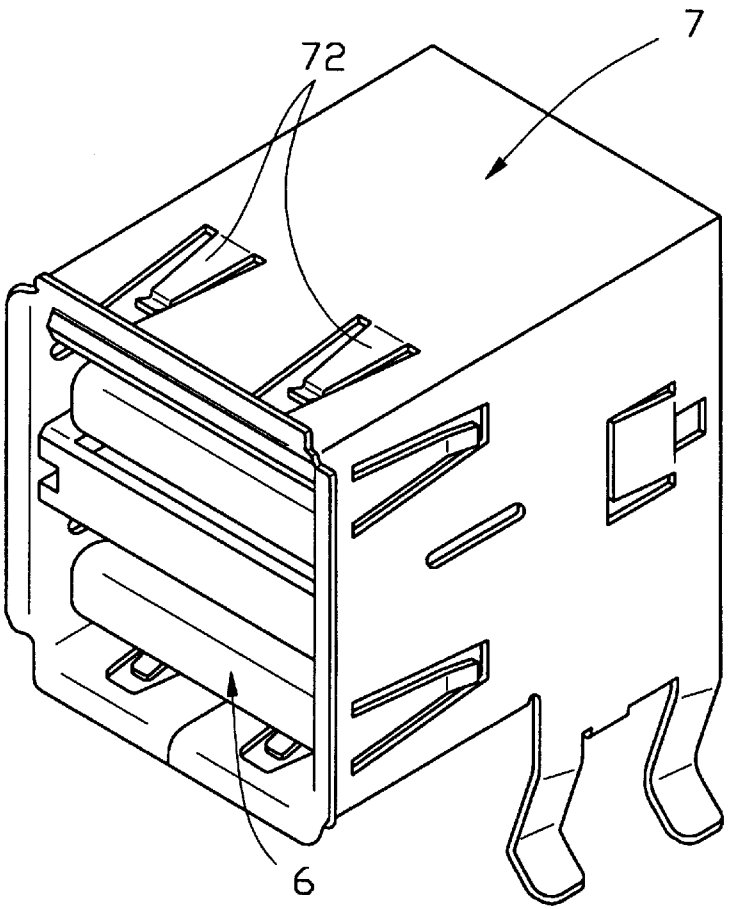
FIG. 1 (PRIOR ART)
FIG. 1 is a perspective view of a conventional electrical connector.
Figure 2:
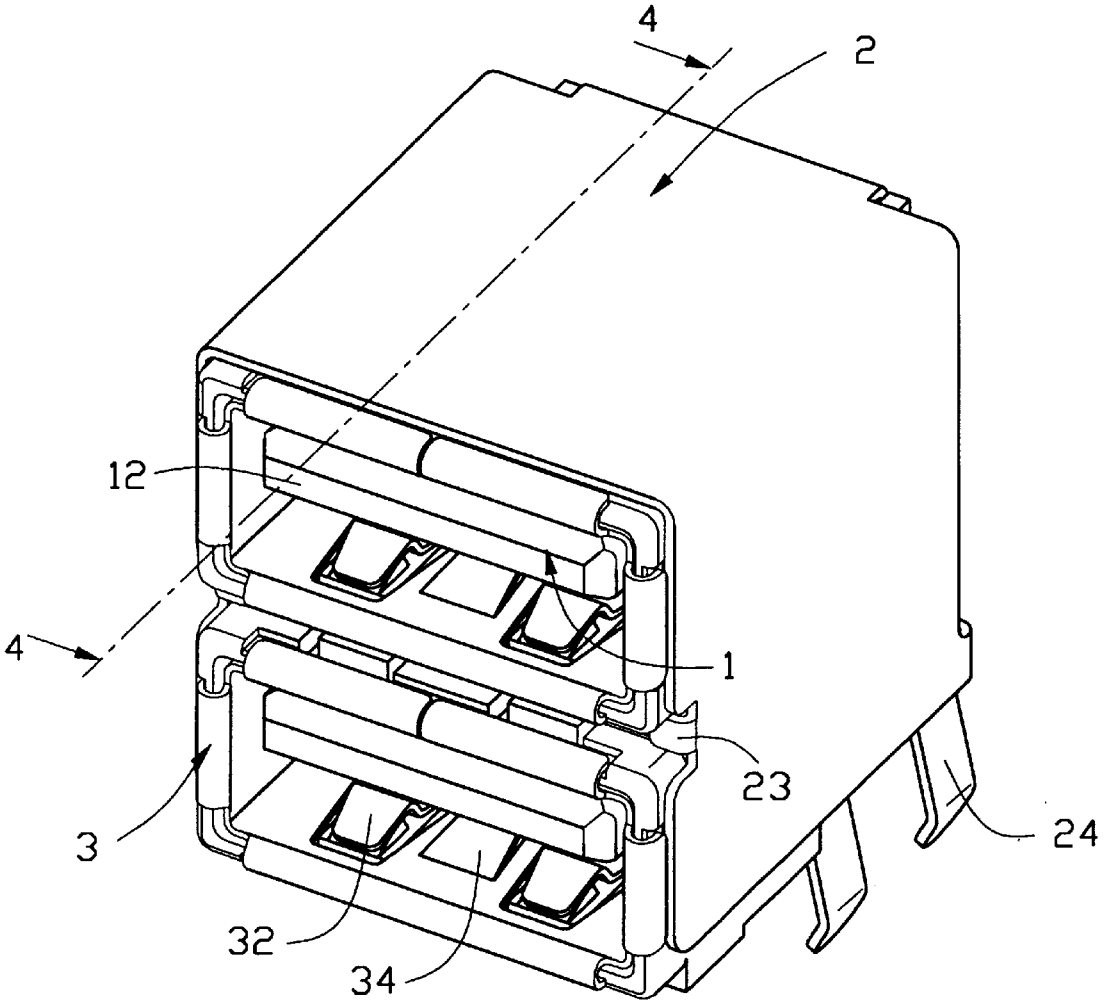
FIG. 2 is a perspective view of an electrical connector of the present invention.

Referring to FIGS. 2 and 4, in assembly, the securing sections 42 of the contacts 4 are interferentially engaged within the corresponding engaging slots 13, 15 of the upper and lower mating boards 12, 16 of the housing 1. The contacting ends 40 are also disposed within the corresponding engaging slots 13, 15 and extend toward the corresponding upper and lower receiving chambers 11, 14 for electrically contacting the corresponding terminals of the mating connector. The connecting ends 44 of the contacts 4 downwardly extend from the corresponding engaging slots 13, 15 for electrically connecting with the circuit board to which the connector is fixed.

The inner shields 3 are then fixed into the corresponding upper and lower receiving chambers 11, 14 for enclosing the contacting ends 40 of the contacts 4 thereby protecting the electrical connections therein from electromagnetic interference. Furthermore, the latching arms 32, the latching tabs 33 and the detents 34 simultaneously extend into the corresponding receiving chambers 11, 14 for latching with the shell of the mating connector and for forming a grounding loop therethrough. Therefore, when the mating connector is inserted into the connector, outer surfaces of the shell of the mating connector will firmly abut against the latching arms 32, the latching tabs 33 and the detents 34 of the connector. Thus, the shell of the mating connector will not become loosened or slide away from the connector thereby ensuring steady electrical engagement between the inner shields 3 and the shell of the mating connector.

The outer shield 2 is assembled to enclose the housing 1, the contacts 4 and the inner shields 3 therein. The clamp 25 is latched within the top cutout 18 of the housing 1. The clasps 23 are latched within the corresponding middle cutouts 17 of the housing 1. Thus, the outer shield 2 is fixed to the housing 1 thereby shielding the contacts 4 from electromagnetic interference.

The housing 1 and the contacts 4 can be altered or modified according to practical requirements with any imaginable creation. For instance, the housing 1 can have three or more receiving chambers forming one or more cantilevered mating boards therein for receiving the corresponding contacts 4. The outer shield of the shielding system also can be selectively altered or modified according to practical requirements. The number of the inner shields 3 can also be modified to correspond the number of receiving chambers in the housing 1. Furthermore, the number of the detents, latching arms or latching tabs of the inner shields can be changed according to practical requirements. Such changes would be in accordance with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a receiving chamber for receiving a mating connector therein, the receiving chamber forming a cantilevered mating board defining a plurality of engaging slots therein;

a plurality of contacts received in corresponding ones of the engaging slots, each contact comprising a contacting end for electrically contacting a corresponding terminal of the mating connector, a securing section latched in the corresponding engaging slot, and a connecting end for electrically connecting with a circuit board; and a shielding system including a metallic inner shield received in the receiving chamber, the inner shield forming a latching arm inwardly extending toward the receiving chamber for latching to and electrically engaging with a shell of the mating connector, a latching tab integrally extending from the latching arm for increasing a retention force of the inner shield to engage with the shell of the mating connector;

wherein the latching tab extends from the latching arm in a direction opposite to a direction in which the latching arm extends, thereby providing the inner shield with sufficient deformation resiliency for securely engaging with the shell of the mating connector.

2. The electrical connector as claimed in claim 1, wherein a detent extends from the inner shield for abutting against the shell of the mating connector.

3. The electrical connector as claimed in claim 1, wherein the shielding system further comprises an outer shell enclosing the dielectric housing for protecting the electrical connector from electromagnetic interference.

4. An electrical connector comprising:

a dielectric housing defining a receiving chamber for receiving a mating connector therein;

a plurality of contacts received within said chamber;

a shielding system including a metallic shield received in the receiving chamber, said shield forming a latching arm integrally extending, from a rear portion thereof, forwardly and inwardly toward the receiving chamber, and a latching tab integrally rearwardly extending from said latching arm for cooperation with said latching arm to commonly engage the mating connector.

* * * * *